US005505128A

United States Patent [19]

van den Brink

[11] Patent Number: 5,505,128

[45] Date of Patent: Apr. 9, 1996

[54] PRINTING DEVICE PROVIDED WITH MOVABLE PRINTING UNIT

[75] Inventor: Lambert D. van den Brink, Cuyk, Netherlands

[73] Assignee: Stork X-cel B.V., An Boxmeer, Netherlands

[21] Appl. No.: 224,290

[22] Filed: Apr. 7, 1994

[30] Foreign Application Priority Data

Jan. 19, 1994 [NL] Netherlands ..... 9400088

[51] Int. Cl.[6] ..... B41F 5/04

[52] U.S. Cl. ..... 101/219; 101/216

[58] Field of Search ..... 101/219, 216, 101/212, 178, 179, 180, 181, 182, 171, 174, 221, 220, 229, 222–228

[56] References Cited

U.S. PATENT DOCUMENTS

| | | | |
|---|---|---|---|
| 3,518,940 | 7/1970 | Stroud et al. | 101/223 |
| 4,169,413 | 10/1979 | Aaron | 101/223 |
| 4,437,402 | 3/1984 | Fischer | 101/181 |
| 4,909,148 | 3/1990 | George | 101/178 |
| 5,117,753 | 6/1992 | Mamberer | 101/225 |
| 5,191,836 | 3/1993 | Weis | 101/219 |
| 5,259,307 | 11/1993 | Bourgeois et al. | 101/118 |

FOREIGN PATENT DOCUMENTS

| | | |
|---|---|---|
| 0509414 | 10/1992 | European Pat. Off. . |
| 321874 | 6/1920 | Germany . |
| 3131168 | 2/1983 | Germany . |

OTHER PUBLICATIONS

COMCO International, "COMCO SERIFLEX™", 2 pages.
COMCO International, "COMCO FLEXOPACK™", 2 pages.
*COMCO Europe Magazin,* Oct. 1993, pp. 1–8.

*Primary Examiner*—Edgar S. Burr
*Assistant Examiner*—Anthony H. Nguyen
*Attorney, Agent, or Firm*—Bell, Seltzer, Park & Gibson

[57] ABSTRACT

A printing device, comprising several printing stations disposed one after the other in the lengthwise direction, and each comprising a main printing unit, at least one additional printing unit, drive means for driving the printing units, and conveyor means for conveying the material to be printed through the printing device, is provided with a movement device for moving the additional printing unit at least in the lengthwise direction of the printing device. The movement device can comprise guide means, movement means and positioning means. An assembly of an additional printing unit and a movement device can also be used in an existing printing device with several printing stations disposed one after the other in the lengthwise direction.

20 Claims, 2 Drawing Sheets

PRINTING DEVICE PROVIDED WITH MOVABLE PRINTING UNIT

BACKGROUND OF THE INVENTION

The invention relates to a printing device, comprising several printing stations disposed one after the other in the lengthwise direction, and each comprising a main printing unit, at least one additional printing unit, drive means for driving the printing units, and conveyor means for conveying the material to be printed through the printing device.

Such a printing device is known. In such a printing device the additional printing unit is used to carry out an additional printing operation on the material to be printed, for example printing an additional colour, or carrying out a different type of printing operation. In the case of the known printing devices there are generally two different systems for placing the additional printing unit in the printing device. In the first system, a main printing unit in a conventional printing press is replaced by an additional printing unit in the form of a rotary screen printing device. When the main printing unit is replaced by the additional printing unit, the main printing unit selected is first detached at the appropriate drive point of the device and then removed therefrom, after which the new, additional printing unit is placed in this position in the device and connected to the drive of the main printing units. In the second system, an additional printing unit is added to the printing device. At a desired position, the printing stations are detached from each other and pushed apart. The additional printing unit is disposed in the space thus created, and is installed in the device and connected to the drive of the main printing units in the printing stations.

Although these printing devices have some flexibility as regards the position of the additional printing unit in the printing device, long fitting times are necessary for installing and converting the printing device, in view of the complexity of the operations which have to be carried out. Besides, in the case of the printing device described above, in which a main printing unit is replaced by the additional printing unit, the total number of printing operations is not increased. In the case of the printing device in which the additional printing unit is disposed between the main printing units, it is necessary for a part of the printing device to be movable and for the space required therefor to be present. This calls for additional facilities, with the costs which this involves.

The object of the invention is to provide a printing device in which the main printing units in the printing stations do not have to be removed or moved in order to add an additional printing unit, so that changeover and resetting times are short.

SUMMARY OF THE INVENTION

According to the invention the printing device of the type described above is provided with a movement device for moving the additional printing unit at least in the lengthwise direction of the printing device.

In the case of the printing device according to the invention, the additional printing unit is not accommodated between the existing main printing units, but instead thereof is disposed above the printing stations. The additional printing unit is movable by means of the movement device. This means that the printing device according to the invention has a number of advantages. For changing the position of the additional printing unit relative to the main printing units, the additional printing unit need only be moved to the desired position above the main printing units by means of the movement device. No operations are required for replacing a main printing unit or installing the additional printing unit between two main printing units. The time required for placing the additional printing unit in the desired position is thus considerably shortened. In addition, setting up the additional printing unit above the main printing stations gives the advantage that a considerable saving in floor space is achieved. Several additional printing units which are movable by the movement device can also be set up, thus increasing the possibilities for greater numbers and more types of printing operations. The additional printing unit can be of the same type as the type of the main printing unit in the printing stations, for example in order to add a further colour. However, the additional printing unit can also be of a different type, in order to provide a better quality of printed work. The printing device according to the invention therefore provides many possibilities both as regards the position and as regards the type of the additional printing unit.

In a preferred embodiment of the printing device according to the invention, the movement device comprises guide means along which the additional printing unit can be moved. The guide means preferably comprise rails extending in the lengthwise direction of the printing device. This makes it possible to move the additional printing unit in a simple way in the lengthwise direction of the printing device to a desired position.

In another embodiment of the printing device according to the invention, the movement device comprises first movement means for moving the additional printing unit along the guide means.

In order to keep the additional printing unit accurately in register with the main printing units in the printing stations, second movement means, which also move the additional printing unit crosswise to the lengthwise direction of the printing device, can be present. With the same object, third movement means, which can rotate the additional printing unit about a vertical axis, can be present. By these movement means, the additional printing unit can be placed accurately in register with the main printing units, because any desired correction of the position of the additional printing unit relative to the main printing units can be carried out with the movement means.

In a further preferred embodiment of the printing device according to the invention, the movement device is provided with positioning means for positioning the additional printing unit in the printing device, in order to lock and retain the additional printing unit in the desired position.

For proper operation of the printing device according to the invention, the drive of the additional printing unit will preferably be connected to the drive of the main printing units in the printing stations.

The drives are advantageously electronically connected to each other (the so-called electronic longitudinal shaft). However, it is also possible to connect the drives mechanically.

In order to combine two different types of printing operation in one printing device, it can be advantageous for the additional printing unit to be of a different type from that of the main printing units in the printing stations. In a preferred embodiment thereof, the additional printing unit is a rotary screen printing unit.

The invention also relates to an assembly of an additional printing unit and a movement device for use in a printing device with several printing stations placed one after the other in the lengthwise direction, and each comprising a main printing unit, the movement device when used in a printing device being designed for moving the additional printing unit at least in the lengthwise direction of the printing device.

Such an assembly can be used in, for example, existing printing devices of any desired type, in order to increase the number or type of printing operations of the printing device.

BRIEF DESCRIPTION OF THE DRAWING

The invention will be explained below with reference to the attached drawings, in which.

DESCRIPTION OF THE PREFERRED EMBODIMENT

Figure 1:
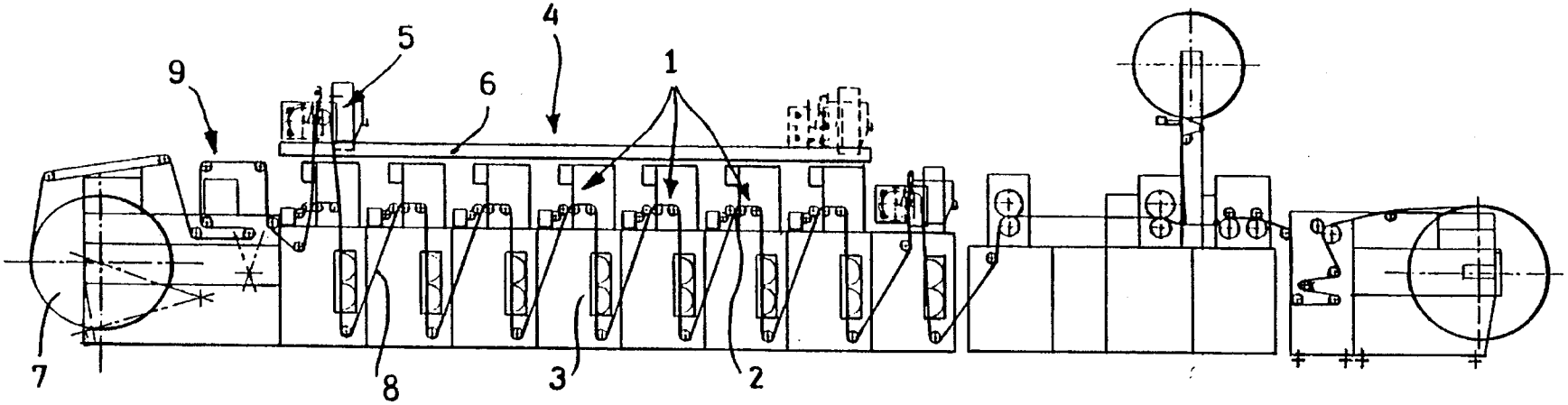
FIG. 1 is a diagrammatic side view of a particular embodiment of a printing device according to the invention.
Figure 2:
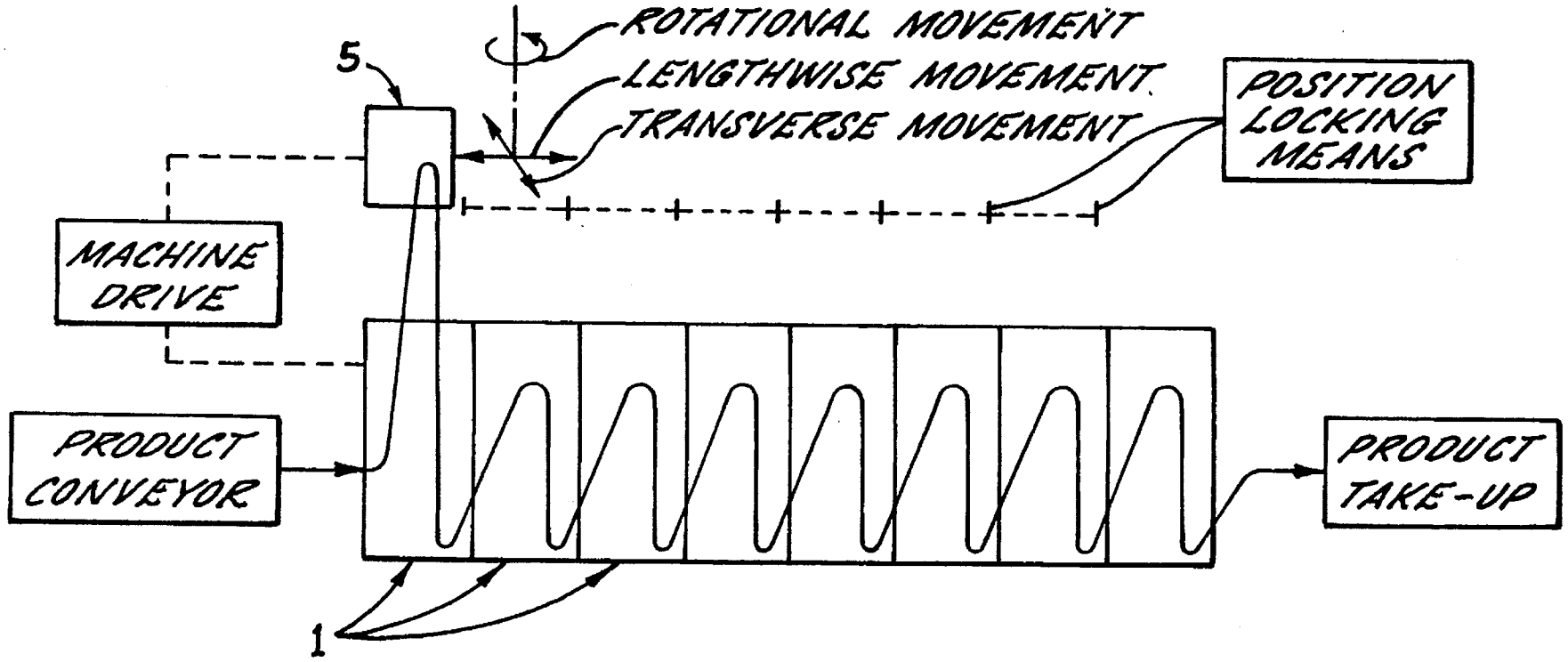
FIG. 2 is a diagrammatic side view of the printing device and further illustrating the three possible movements of the additional printing unit.

In the printing device shown in FIG. 1, a number of printing stations 1 are disposed one after the other. Each printing station comprises a main printing unit 2 and a drying unit 3. The main printing units 2 can be of any type. Examples thereof are flexographic, screen printing and intaglio devices, and also offset printing devices or combinations thereof. Disposed above the printing stations 1 is a movement device according to the invention, indicated in its entirety by reference number 4. An additional printing unit 5 is movable by means of the movement device 4 in the lengthwise direction of the printing device and above the printing stations 1. The movement device 4 comprises guide means 6, for example in the form of two parallel rails, and also movement means (not shown) for moving the additional printing unit 5 along the guide means 6, and positioning means for positioning the additional printing unit 5 in the printing device. The printing device can also be provided with movement means for moving the additional printing unit 5 crosswise to the lengthwise direction of the printing device and for rotating said unit about a vertical axis. These means ensure accurate positioning in register and holding of the additional printing unit 5 relative to the main printing units 2 lying below it. The drying units 3 of the main printing stations 1 can be used both for the additional printing unit 5 and for the main printing unit 2.

In the case of the embodiment shown here, the additional printing unit 5 consists of a rotary screen printing device which is disposed above the first printing station. Another position of the additional printing unit 5 on the guide means 6 is shown by dotted lines.

A stock roll 7 with material 8 to be printed is present at the beginning of the printing device. Suitable conveyor means, indicated in their entirety by reference number 9, for example drive rolls, guide the material web 8 from the stock roll 7 through the main printing units 2 into the printing stations 1 and the additional printing unit 5 above the printing stations 1. The remaining processing stations for the printed material are disposed downstream of the printing stations 1.

The drive means for driving the main printing units 2 and the additional printing unit 5 consist, for example, of a so-called electronic longitudinal shaft, i.e. drive means for each main printing unit 2 and additional printing unit 5 which are electronically connected to each other.

An assembly of an additional printing unit 5 and a movement device 4 according to the invention is also suitable for extending existing printing devices in a simple way by placing the assembly above the existing printing device.

The invention is not restricted to the example of an embodiment described above.

For example, the movement device can also be disposed next to the printing device.

The additional printing unit is then placed above the printing stations from the side.

It is also possible to place the additional printing unit downstream of one of the further processing stations disposed downstream of the printing stations, for example in the case of hot foil stamping (where a foil is applied to printed labels) and subsequent additional printing.

What is claimed is:

1. A printing apparatus comprising:

a plurality of main printing units disposed one after the other in a lengthwise direction, at least one additional printing unit, means mounting said one additional printing unit for selective movement along a lengthwise path of travel located adjacent the main printing units and so as to permit the one additional printing unit to be positioned adjacent a selected one of said main printing units, said mounting means for said one additional printing unit further including support means mounting said one additional printing unit for selective movement along a second path of travel which is transverse to the lengthwise direction.

2. The printing apparatus as defined in claim 1 wherein said mounting means for said one additional printing unit comprises guide rails extending in the lengthwise direction.

3. The printing apparatus as defined in claim 1 wherein said mounting means for said one additional printing unit further includes support means mounting said one additional printing unit for rotational movement about a vertical axis.

4. The printing apparatus as defined in claim 1 further comprising interconnected drive means for concurrently driving each of said main printing units and said one additional printing unit.

5. The printing apparatus as defined in claim 1 further comprising position locking means for positioning the one additional printing unit in a desired position along said path of travel.

6. The printing apparatus as defined in claim 1 wherein said main printing units are of a uniform type selected from the group consisting of flexographic, rotary screen, intaglio, and offset printing devices, and said additional printing unit is a different one of said group.

7. The printing apparatus as defined in claim 1 wherein said one additional printing unit is a rotary screen printing device.

8. The printing apparatus as defined in claim 1 further comprising conveyor means for conveying a material to be printed through the main printing units and the one additional printing unit.

9. A printing apparatus comprising:

a plurality of main printing units disposed one after the other in a lengthwise direction, at least one additional printing unit, means mounting said one additional printing unit for selective movement along a lengthwise path of travel located directly above the main printing units and so as to permit the one additional printing unit to be positioned directly above a selected one of said main printing units, said mounting means comprising guide rails extending in the lengthwise direction and support means mounting said one additional printing unit (1) for selective movement along said guide rails in the lengthwise direction, (2) for selective movement along a second direction which is transverse to the lengthwise direction, and (3) for selective rotational movement about a vertical axis, so as to permit the one additional printing unit to be accurately registered above any one of said main printing units.

10. The printing apparatus as defined in claim 9 further comprising interconnected drive means for concurrently driving each of said main printing units and said one additional printing unit, and conveyor means for conveying a material to be printed through the main printing units and the additional printing unit.

11. The printing apparatus as defined in claim 9 further comprising position locking means for positioning the one additional printing unit in a desired position along said path of travel.

12. An assembly comprising:

an additional printing unit, means mounting said additional printing unit for selective movement along a lengthwise path of travel located adjacent a plurality of main printing units disposed one after the other in the lengthwise direction, and so as to permit the additional printing unit to be positioned adjacent a selected one of said main printing units, said mounting means for said additional printing unit further including support means mounting said additional printing unit for selective movement along a second path of travel which is transverse to the lengthwise direction.

13. The assembly as defined in claim 12 wherein said mounting means for said additional printing unit comprises guide rails extending in the lengthwise direction.

14. The assembly as defined in claim 12 wherein said mounting means for said additional printing unit further includes support means mounting said additional printing unit for rotational movement about a vertical axis.

15. The assembly as defined in claim 12 further comprising position locking means for positioning the additional printing unit in a desired position along said path of travel.

16. The assembly as defined in claim 12 wherein said additional printing unit is a rotary screen printing device.

17. The assembly as defined in claim 12 wherein said mounting means comprises guide rails extending in the lengthwise direction and support means mounting said additional printing unit (1) for selective movement along said guide rails in the lengthwise direction, (2) for selective movement along a second direction which is transverse to the lengthwise direction, and (3) for selective rotational movement about a vertical axis, so as to permit the additional printing unit to be accurately registered adjacent any one of said main printing units, and further comprising position locking means for positioning the additional printing unit in a desired position along the path of travel.

18. A printing apparatus comprising:

a plurality of main printing units disposed one after the other in a lengthwise direction, said main printing units being of a uniform type selected from the group consisting of flexographic, rotary screen, intaglio, and offset printing devices, at least one additional printing unit, said additional printing unit being a different one of said group, means mounting said one additional printing unit for selective movement along a lengthwise path of travel located adjacent the main printing units and so as to permit the one additional printing unit to be positioned adjacent a selected one of said main printing units.

19. The assembly as defined in claim 18 further comprising position locking means for positioning said one additional printing unit in a desired position along said path of travel.

20. An assembly comprising:

an additional printing unit, means mounting said additional printing unit for selective movement along a lengthwise path of travel located adjacent a plurality of main printing units disposed one after the other in the lengthwise direction, and so as to permit the additional printing unit to be positioned adjacent a selected one of said main printing units, said mounting means comprising guide rails extending in the lengthwise direction and support means mounting said additional printing unit (1) for selective movement along said guide rails in the lengthwise direction, (2) for selective movement along a second direction which is transverse to the lengthwise direction, and (3) for selective rotational movement about a vertical axis, so as to permit the additional printing unit to be accurately registered adjacent any one of said main printing units, and further comprising position locking means for positioning the additional printing unit in a desired position along the path of travel.

* * * * *